US006338451B1

(12) United States Patent
Dörfel et al.

(10) Patent No.: US 6,338,451 B1
(45) Date of Patent: Jan. 15, 2002

(54) CROSS CUTTING DEVICE FOR A WINDING MACHINE

(76) Inventors: G. Walter Dörfel, Beethovenstrasse 21, 7325 Boll; Jürgen Treutner, Elsterweg 17, 7302 Ostfildern 3, both of (DE); Donald Gangemi, 34 Seekonk Crossroads, Great Barrington, MA (US) 01230

( * ) Notice: Subject to any disclaimer, the term of this patent is extended or adjusted under 35 U.S.C. 154(b) by 0 days.

(21) Appl. No.: 09/180,425

(22) PCT Filed: Jun. 13, 1997

(86) PCT No.: PCT/EP97/03095

§ 371 Date: Nov. 9, 1998

§ 102(e) Date: Nov. 9, 1998

(87) PCT Pub. No.: WO97/47546

PCT Pub. Date: Dec. 18, 1997

(30) Foreign Application Priority Data

Jun. 13, 1996 (DE) ..... 296 10 199 U

(51) Int. Cl.[7] ..... B65H 35/08; B65H 35/04; B65H 19/28; B65H 19/22

(52) U.S. Cl. ..... 242/527; 242/527.3; 242/526.1; 242/532.3; 242/533.1

(58) Field of Search ..... 242/527, 527.3, 242/542, 526.1, 532.3, 533.1

(56) References Cited

U.S. PATENT DOCUMENTS

| | | | |
|---|---|---|---|
| 1,934,913 A | 11/1933 | Crisp | 242/56 |
| 5,222,679 A | 6/1993 | Dropczynski et al. | 242/56 |
| 5,639,045 A | 6/1997 | Dorfel | 242/527 |

FOREIGN PATENT DOCUMENTS

| | | |
|---|---|---|
| DE | 29 30 474 B1 | 7/1979 |
| DE | 30 08 785 A1 | 3/1980 |
| DE | 91 10 490 | 8/1991 |
| EP | 0640 544 A1 | 8/1993 |
| EP | 0 716 997 A1 | 11/1995 |
| FR | 2 547 802 | 6/1984 |
| GB | 2 070 495 | 2/1981 |
| JP | 57-121220 | 7/1982 |
| JP | 57-165554 | 9/1982 |
| JP | 59-88875 | 5/1984 |

*Primary Examiner*—John Q. Nguyen

(57) ABSTRACT

In a cross cutting device for a winding machine having at least a first carrier roll (11) wrapped by the web to be wound and a second carrier roll, both carrier rolls forming a winding bed for at least one roll (13) to be wound around a winding core (14), particularly for winding paper in form of one web or several webs in parallel, a cross cutting device to cut through the web after completion of a roll (13) is formed near the front end of a support beam (24) being conductible through a clearance gap (G) between a first and second carrier roll into a cutting position of the cross cutting device which is located at or close to the surface of said first carrier roll (11). Said support beam (24) can be pressed by means of a finished wrapped roll (13) against said wrapped first carrier roll (11). The cross cutting device, further, comprises a clamping device being conductible counter to the web running direction into the clamping position and there, overlapping the arriving web edge of the next roll to be wound, securely clamps said arriving web edge independently of the cross cutting device. Said cross cutting device being conductible back through the clearance gap (G) between said carrier rolls to its home position and after one or several new winding core or cores has/have been loaded said clamping device being detachable from the web edge and being conductible back in the web running direction to its home position.

18 Claims, 17 Drawing Sheets

3
11
23
24
22
35
21
31
23
34
35
31
3
30
33

CROSS CUTTING DEVICE FOR A WINDING MACHINE

BACKGROUND OF THE INVENTION

The invention relates to a cross cutting or cross severing device for a winding machine having at least one carrier roll, preferably two carrier rolls, to wind winding material, particularly paper or the like, in the form of a web, having a cross cutting or cross severing means in order to cut or sever a web after completion of a roll and having a clamping device in order to securely clamp the web edge formed by the cross cutting.

The cross cutting means features may border recesses which stand back behind the cutting edge, in which the clamping means of a clamping device can grasp. A cross cutting device of this type is known from DE-B-29 30 474. In order to start a cross cutting process with this known cross cutting device, first a holding strip or bar is pushed through a clearance gap between two carrier rolls. The holding strip or bar is located on the leading end in the running direction of a support in the form of a shell-shaped segment, and, after reaching its working position, can be pressed against the surface of a carrier roll around which a web is wrapped, with the aid of a pressurized drive having rounded finger elements. An arriving web is thus pressed in a clamping manner against a wrapped carrier roll in front of the cross cutting location in the web running direction. In order to later sever the web, a perforating strip extending approximately parallel to the axis of the carrier roll is swung counter to the rotating direction of the wrapped carrier roll into the cross cutting position. Here, the cross cutting blade pushes between the surface of the roll and the web to be cut and encounters the web to be cut through at a certain radial clearance from the surface of the carrier roll, that is from below. Here, the cross cutting force works counter to the holding force of the finger-shaped holding means. Provided that the cross cutting blades are sufficiently sharp and the material properties of the web to be severed are suitable, the web to be severed will be perforated near the clamping location determined by the clamping means. The cross cutting blade then further travels a short distance in its original running direction until the border recesses provided in the cross cutting blade and the finger-shaped clamping means mesh with each other. The cutting region of the cross cutting blade then is located above the web which has been crosscut, i.e., radially outside with respect to the carrier roll around which the web is wrapped. In this position, the blade-holding beam carrying the cross cutting blade is swung as a unit in such a manner that a border zone arching slightly outward near the blade edge will be pressed against the border zone of a web edge formed by means of the cutting process, such that this web edge will be clamped between the underside of the blade and the wrapped carrier roll. The holding means with clamping fingers then is swung back and drawn back though the clearance gap between the two carrier rolls, while the web edge formed by the cross cutting remains securely clamped by means of the cross cutting blade.

First, this known cross cutting device is costly and is provided with four driving means. Next, the combination of a clamping means and cross cutting blades working counter to the clamping means leads to a satisfactory result only if the cross cutting blade is sufficiently sharp and the quality of the web to be wound and crosscut is suitable for this type of perforating process. For example, when the web to be wound and to be cut crosswise is of a material reinforced in the web running direction, the danger exists that under the effect of the clamping fingers and cross cutting blade working counter to the web, the web will not only be perforated in a transverse direction but that it will also tear in a longitudinal direction at the lateral edges of the fingers. This results in a web being pressed down against the wrapped carrier roll in the region of the clamping means and continuing to be lifted in the region of the intermediate cross cutting zones of the wrapped carrier roll. If this occurs, it is no longer possible to move the cross cutting blade across the cross cutting location with the requisite certainty and later to press the edge zone of the web close to the cross cutting location down onto the carrier roll. Since the drives for the clamping means and cross cutting blade are independent of each other, it furthermore is difficult to coordinate the two components working interactively, i.e., clamping fingers and cross cutting blade, in such a manner that a mutual clamping position is achieved in which the clamping fingers and cross cutting blade are conducted counter to each other just far enough that they mesh with each other exactly.

BRIEF SUMMARY OF THE INVENTION

Starting from here, the invention solves the problem of achieving and increased certainty of operation and simpler construction for a cross cutting device for the same generic class having a clamping device. This is solved in accordance with the invention by means of the fact that for a cross cutting device of the same generic class, the cross cutting means can be conducted in a manner known per se by a support beam through a clearance gap between two carrier rolls or, alternatively, close to the periphery of said first carrier roll into a cross cutting position located at or close to the surface of the carrier roll around which the web is wrapped, and comprising means to press the support beam and/or the cross cutting means by a finished roll of said winding material against the wrapped carrier roll, for the purpose of tightening and cutting the web, by means of the finished wrapped roll, and that—eventually—a second clamping device can be conducted into its clamping position counter to the web running direction and there, overlapping the arriving web edge of the next roll to be wound, securely clamps it independently of the cross cutting means, and the cross cutting means can be conducted back through the clearance gap of the carrier rolls to its home position, and the eventual second clamping means, after a new winding core has been loaded, can be detached from the web edge and the clamping means can be conducted back in the web running direction.

The invention achieves a cross cutting of the web simply, due to the force of the weight of a finished wound roll in such a manner that the wound roll immobilizes the cross cutting means, which may act like a clamping means only, in a position which can be precisely determined beforehand, and the cross cutting process is carried out by tightening the web end along a straight line by moving the wound roll away from the first carrier roll, whereby the web becomes tightened longitudinally and breaks. It will be appreciated that the front end or edge of the support beam will clamp the arriving web end close to the intended cross cutting line very uniformly along an elongated straight line in cross machine direction. Even if the cross cutting means is of a non-sharp type or has lost its sharpness and/or the material of the web to be cut crosswise has a tendency to tear longitudinally, this type of cross cutting works safely. The cross cutting means immobilizes the web to be cut crosswise over the major length of the cross cutting line, thus tightening the web to be cut crosswise sufficiently along the cross cutting line to avoid a longitudinal tearing of the web, for instance at the edges of eventually provided recesses of the cross cutting means, or other cross cutting defects.

A cross cutting device, according to a first embodiment of this invention, for which a cross cutting blade can be conducted by a blade-holding beam through a clearance gap between two carrier rolls into the cutting position, and the blade-holding beam, for the purpose of tightening and cutting the web, can be pressed against the wrapped carrier roll by means of a finished wound roll is known per se from EP-A1-0 640 544, which is incorporated by reference herewith. However, this known cross cutting blade does not feature any border recesses and, in addition, the border zone of an arriving web edge, i.e., the start of the web for the next winding process, is pressed against the wrapped carrier roll only by means of the blade-holding beam and no other clamping means being used. When a new winding core is loaded, the known cross cutting blade therefore must be conducted back through the clearance gap between the two carrier rolls, and the arriving web must be held against the wrapped carrier roll by a different means, such as a vacuum, until the next winding core has been loaded and the next winding process has begun.

Unlike the cross cutting device known from DE-B1-29 30 474 mentioned here before the arriving web edge is, in accordance with the invention, held closely to the wrapped carrier roll by the support beam of the cross cutting means after the cross cutting process close to the cross cutting line on practically the entire length of the cross cutting line, preferably until the clamping means of a clamping device, coming from a direction counter to the general web running direction, has overlapped the crosscut web edge and has securely clamped the border zone of the arriving web edge close to the cross cutting means. This guarantees a secure function of this additional clamping device and avoids a case where the clamping means finds itself between the carrier roll surface and the web edge, where it would become ineffective.

An arrangement in accordance with the invention makes sure that the cross cutting means and its support beam, in comparison to other known cross cutting devices (JP-A-60-23 23 58), can be of a comparatively stable design and can be employed over a correspondingly long time, practically free of maintenance and with a secure function. Web material that requires a greater force to be crosscut is also capable of being crosscut without trouble.

While the comparatively stable cross cutting means and its support beam can be conducted back through the clearance gap between the two carrier rolls after the cross cutting process and after the new clamping means has overlapped the arriving web edge, only the comparatively small-dimensioned clamping device remains close to the cross cutting line, which does not hinder the consequent loading of a winding core or cores into the bed between the two carrier rolls for the next winding process. In particular, a winding core or cores can be loaded in a position which is extremely close to the cross cutting line, such that the new web start is located very close to the line of contact between the web and the new winding core or cores. The comparatively lightweight construction of the clamping device permits a rapid drawing back of the clamping device to its home position after a new winding core or cores has/have been loaded.

The cross cutting device according to the present invention can be practiced in various embodiments:

For instance, as a first embodiment, the cross cutting means can comprise a cross cutting blade which is fixed on the front edge of the support beam, such as known per se in the art. The cross cutting blade is more or less sharp and acts in a way that the web will tear off immediately at the cutting edge of the cross cutting blade as soon as the tensioned web touches said cutting edge under a sufficient angle. This happens when the wound roll is displaced from the wrapped carrier roll onto the cross cutting beam, for instance by lowering the non-wrapped (second) carrier roll. By this displacement of part of the weight of the wound roll from the wrapped carrier roll to the support beam, the front zone of the support beam, when seen in the web-running direction, abuts against the web close to the cross cutting position and further against the wrapped carrier roll.

According to another embodiment, the web is first perforated along the line at which the cross cutting has to take place.

Although the web may be perforated on a place of the web prior to that place on the web contacting the first carrier roll, the preferred embodiment is to perforate at a location already in contact with the first carrier roll. This location is preferred because the sheet is held flat to avoid stress concentration that might cause the sheet to tear prematurely. Before the carrier roll, additional equipment would be required to insure this. Another advantage of the preferred embodiment is that the angle of wrap between the perforation location and the location where the sheet first touches the carrier roll, helps to isolate the sheet at the perforations from tension variations, occurring between the drum and the parent reel.

The perforation line is thereafter transported along the periphery of the wrapped carrier roll to the predetermined position in the machine where the cross cutting has to take place, i.e., when seen in the web running direction, to a position behind the closest distance between the peripheries of the first and second carrier rolls. Due to the perforation, the cross cutting means does not need to be more or less sharp (as necessary in the first embodiment), but only be designed to abut against the web near the cross cutting line in a position of the machine which is close to the intended cutting position. According to this embodiment, the location of the perforation line, when arrived in the cross cutting position within the machine, does not need to be identical with the line along which the cross cutting means is clamping the web against the wrapped carrier roll. Instead, the cross cutting line, when arrived in the cross cutting position, may be positioned beyond the clamping line of the cross cutting device when seen in the web running direction. Thereby, a small strip of the arriving web, i.e., at the upstream side of the cross cutting line, extends in cross machine direction between the clamping line of the cross cutting means and the cross cutting line. This strip can be gripped, i.e., clamped easily by a clamping device being moved into the cross cutting position from the opposite side with respect to the movement of the cross cutting means. Such pre-perforation eases the cross-cutting and allows a simple procedure for applying fixing means, like an adhesive, close to both sides of the cross cutting line to the web in order to fix the arriving web edge to a new core for the next winding process and the leaving web edge to the surface of the wound roll.

The aforementioned and claimed procedural steps and components described in the embodiments and to be used in accordance with the invention are not subject to any special exceptions with respect to their procedural conditions, size, design, material selection and technical conception, such that the selection criteria known in the relevant sphere of application can find unlimited use.

BRIEF DESCRIPTION OF THE DRAWINGS

Additional details, features and advantages of the object of the invention ensue from the following description of the associated figure which represents two preferred embodiments as an example. The figure shows

FIG. 7: The same cross cutting device immediately after the loading of a new winding core;

DETAILED DESCRIPTION OF THE INVENTION

Figure 2:
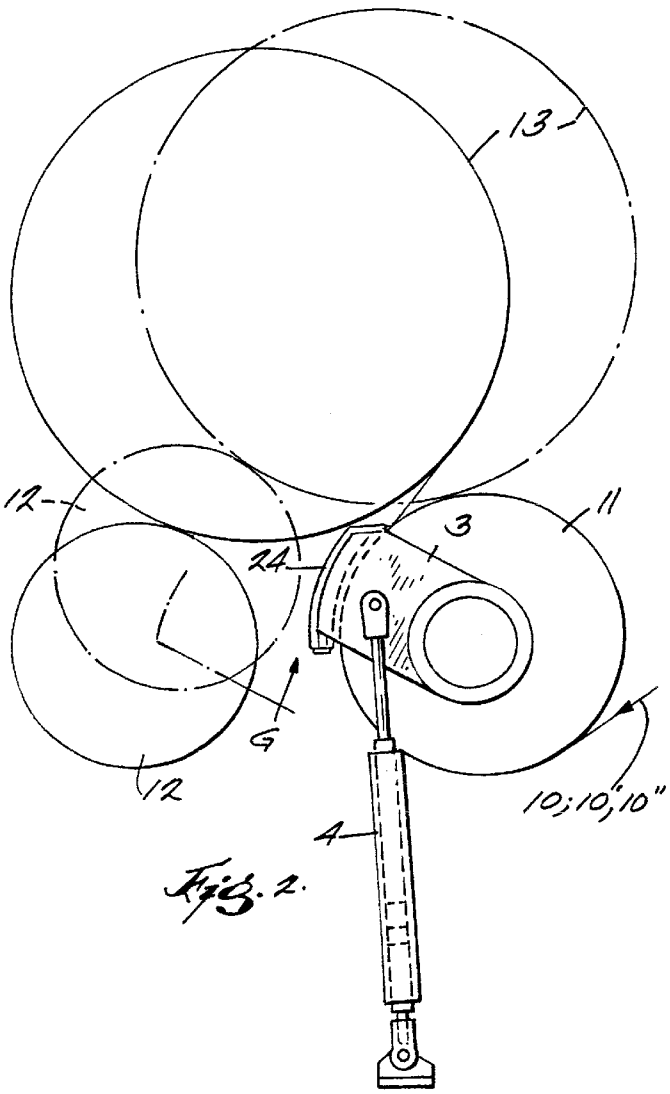
FIG. 2: The same cross cutting device during a cross cutting process, in two positions of the roll to be crosscut.
Figure 1:
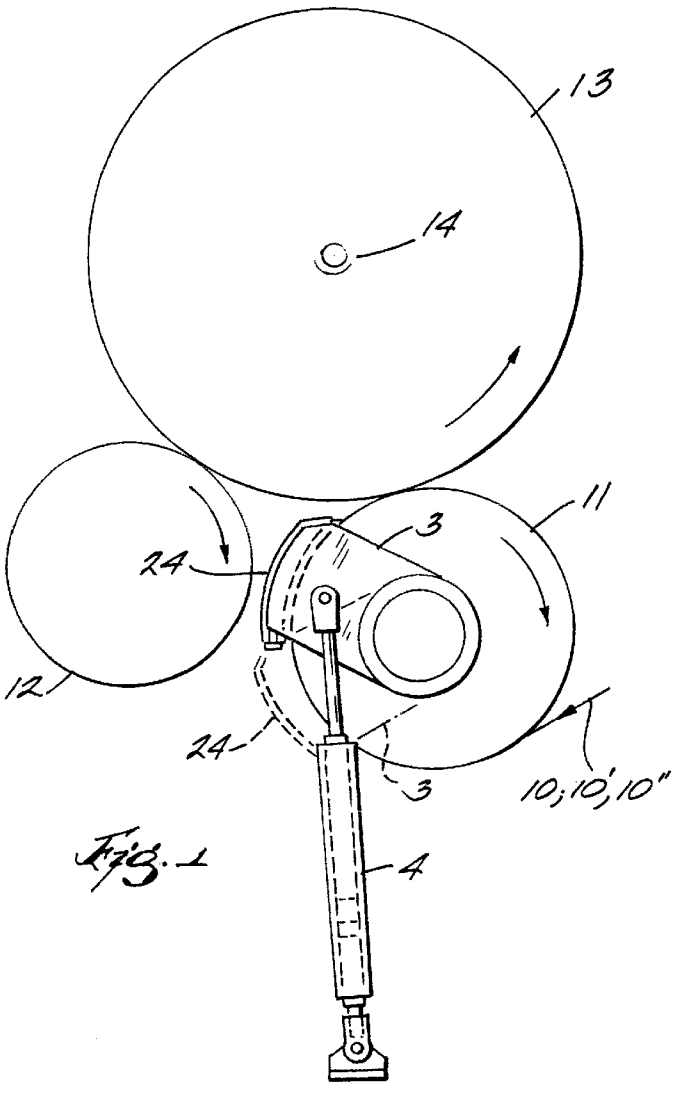
FIG. 1: A winding machine in a first embodiment having a cross cutting device, in side view, in different positions of the cross cutting blade.
Figure 2A:
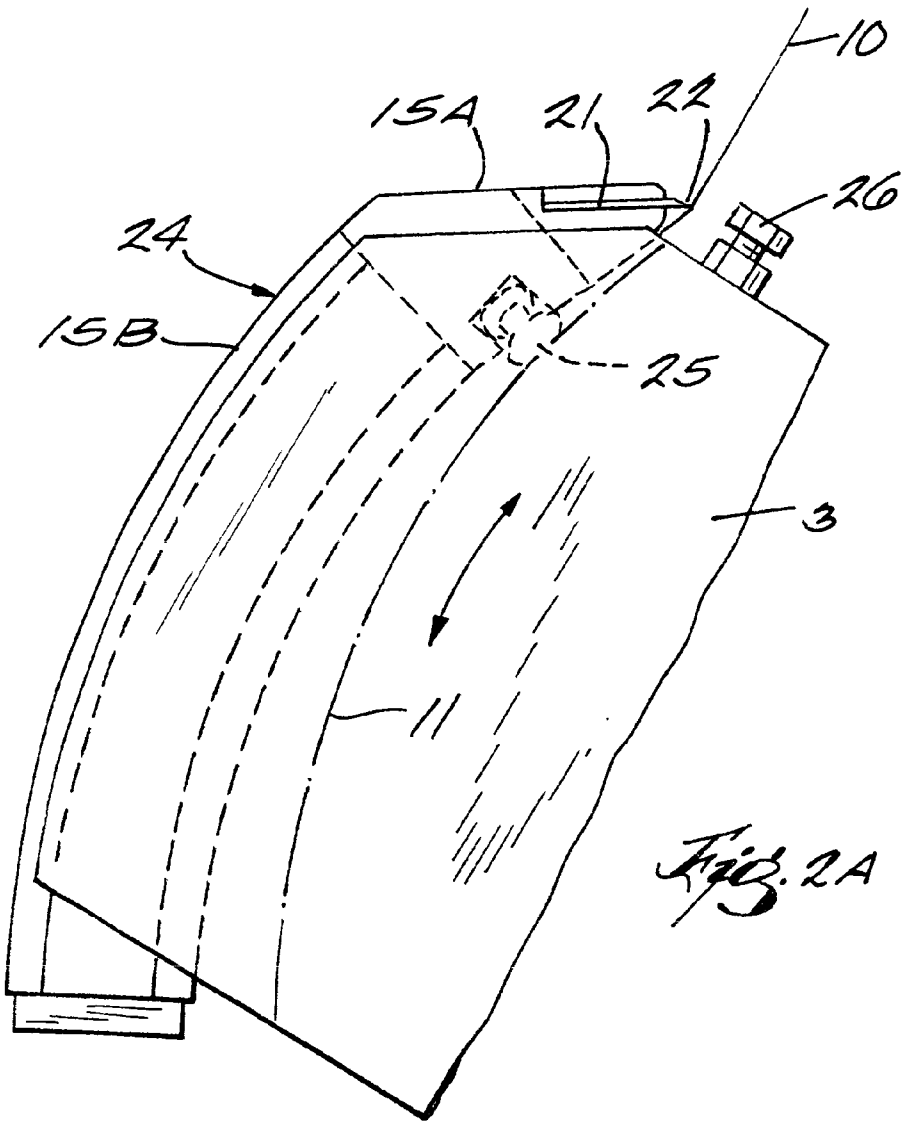
FIG. 2A: The device of FIG. 2 including an enlarged detail of the cross cutting means next to the blade support beam.
Figure 3:
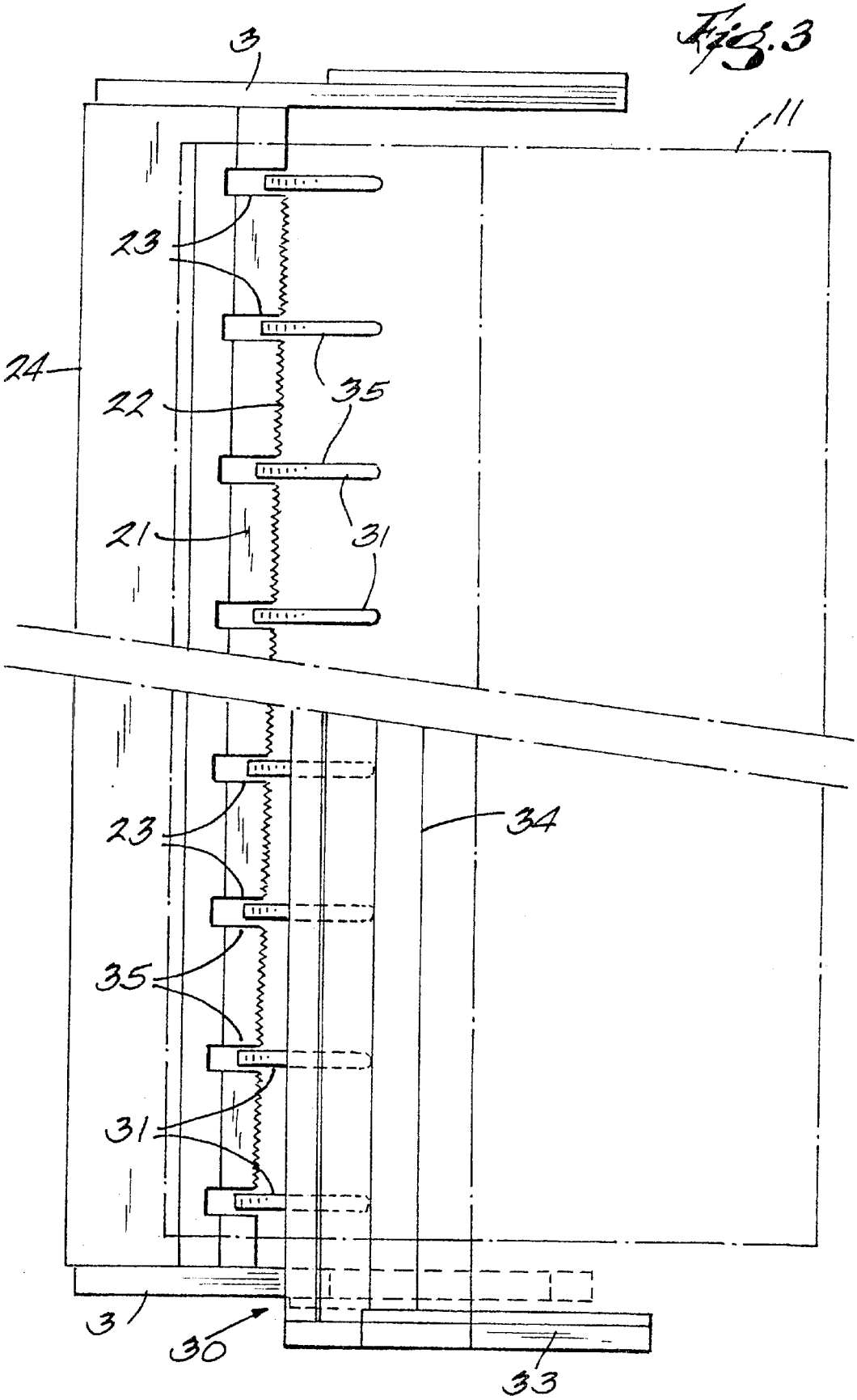
FIG. 3: A top view of the same cross cutting device (View A—A in accordance with FIG. 4)

As is evident from FIGS. 1 and 2, a cross cutting device in accordance with the invention is used for a winding machine having for instance two carrier rolls 11, 12, between which a winding bed is formed in order to wind winding material 10, particularly paper or the like, in the form of a broad web or in the form of a couple of smaller webs being cut lengthwise from a broad web. For this purpose, the winding material 10 wraps around the first carrier roll 11 in the web running direction and is guided from below through the clearance gap G between both carrier rolls. The two carrier rolls carry a roll 13 of the winding material, which is wound around a winding core 14. The cross cutting device features a toothed cross cutting blade 21 which extends along the entire machine width, i.e., along the entire web width. Border recesses 23 which stand back are featured behind the cutting edge 22 of this blade, as is evident from FIG. 3. This type of border recesses can also be formed by fixing blade sections, with a lateral clearance from each other, to the support beam 24 for carrying a cross cutting blade 21.

The support beam, i.e., the blade-holding beam, can be swung through the clearance gap G between the two carrier rolls 11, 12, by means of swinging arms 3 which are supported at both ends of the carrier roll 11 and off center of it in a manner permitting swinging motion and which can be swung by means of a drive 4. This is particularly clear from FIG. 1 which uses dotted-dashed lines to represent a lower home position as well as an upper waiting position of the support beam 24. In the home position of the support beam, the two carrier rolls can be positioned more closely to each other than is represented in FIG. 1, such that they also can form a winding bed for small caliber winding cores 14 (see FIG. 7). As is evident from FIG. 2, the carrier roll 12 can be moved away from the carrier roll 11 by being lowered and increasing the clearance by the same time. A cross cutting device in accordance with the invention is especially suited for the type of winding machine known from EP-A-0 640 544, since with this machine a comparatively large and variable clearance gap between the carrier rolls can be realized for the cutting process, which permits a very solid design of the support beam.

While in FIG. 1 the end phase of the winding process has been reached and the support beam 24 is already located in its waiting position located just in front of the cross cutting position, FIG. 2 represents how, by lowering the second carrier roll 12 with a simultaneous increase of the clearance gap (G), a finished wound roll 13 is lowered in a manner such that it is displaced from the first carrier roll 11 to the support beam 24. For this purpose, the latter features a first and a second run-off diagonal 15A, 15B.

It is further evident from FIGS. 1 and 2 that the rotating support of the swinging arm 3 of the support beam 24 is carried out eccentrically with respect to the rotating axis of the carrier roll 11 such that the support beam 24 maintains a sufficiently safe clearance from the surface of the carrier roll 11 in the waiting position, and all the more so in the home position. Not until the cutting position represented in FIG. 2 has been reached the cutting edge 22 of the cross cutting blade 21 come quite close to the surface of the carrier roll 11, such that the cross cutting location of a web (10) to be wound is removed by only an extremely limited clearance from the surface of the carrier roll during the cross cutting process.

In order to prevent damage to the carrier roll 11 with particular certainty during the rolling-off process of the roll 13 and during cross cutting, a support cushion 25 is arranged on the bottom side of the support beam (24). This support cushion can consist of individual short support cushions or a liner support element and, as best preferred, can be conducted in and out with respect to the support beam, and/or can be inflatable. In the embodiment represented and, in this respect, preferred, the support cushion simultaneously serves as a clamping means, which is used to hold the winding material to be crosscut in position on the surface of the carrier roll 11 close to the cross cutting line.

Figure 4:
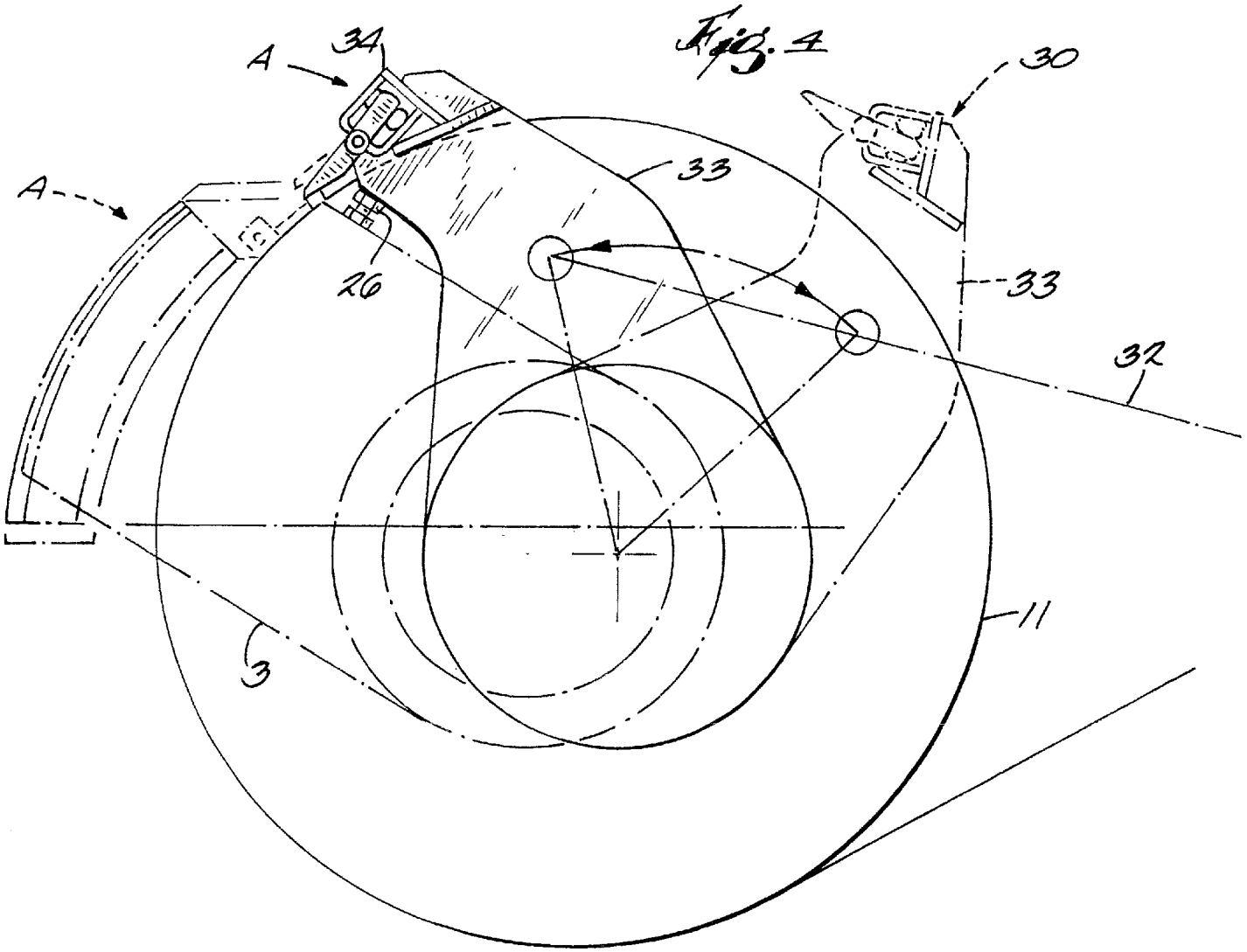
FIG. 4: The same cross cutting device with an additional representation of a clamping device in two positions.
Figure 5B:
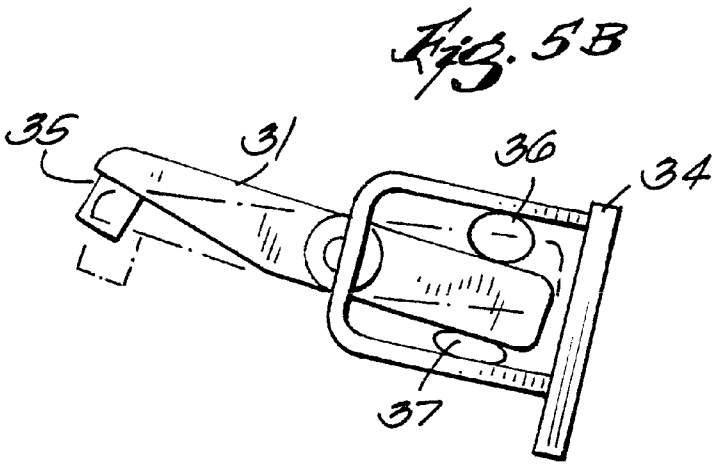
FIGS. 5A–B: From the same clamping device, the clamping fingers next to their pivot drive, in different working positions (detail of FIG. 4)
Figure 5A:
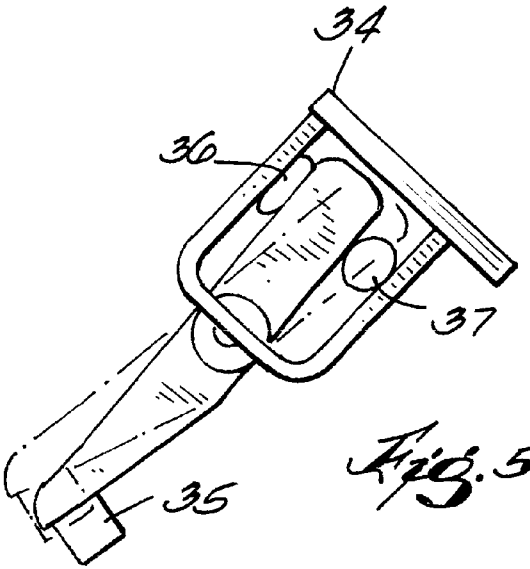

Finally, an adjustable limit stop 26 is arranged on the swinging arms 3 in a manner such that the clamping device represented in FIGS. 4 and 5 always comes to rest in a final position which can be predetermined with respect to the cutting edge 22 of the cross cutting blade 21, before the clamping means is put into action.

FIG. 4 represents an additional clamping device for securely clamping a web edge formed by means of the crosscut. This consists of a clamping-means carrier 34, which extends across the entire machine width and which can be swung from a home position (represented by a dotted-dashed line in FIG. 4) into a clamping position (represented by solid lines in FIG. 4) and back on swinging arms 33 pivoted on both sides of the carrier roll 11, by means of driving means 32. This swinging is carried out eccentrically to the axis of the carrier roll 11, such that the clamping means approaches the surface of the carrier roll when approaching the clamping position.

Figure 6:
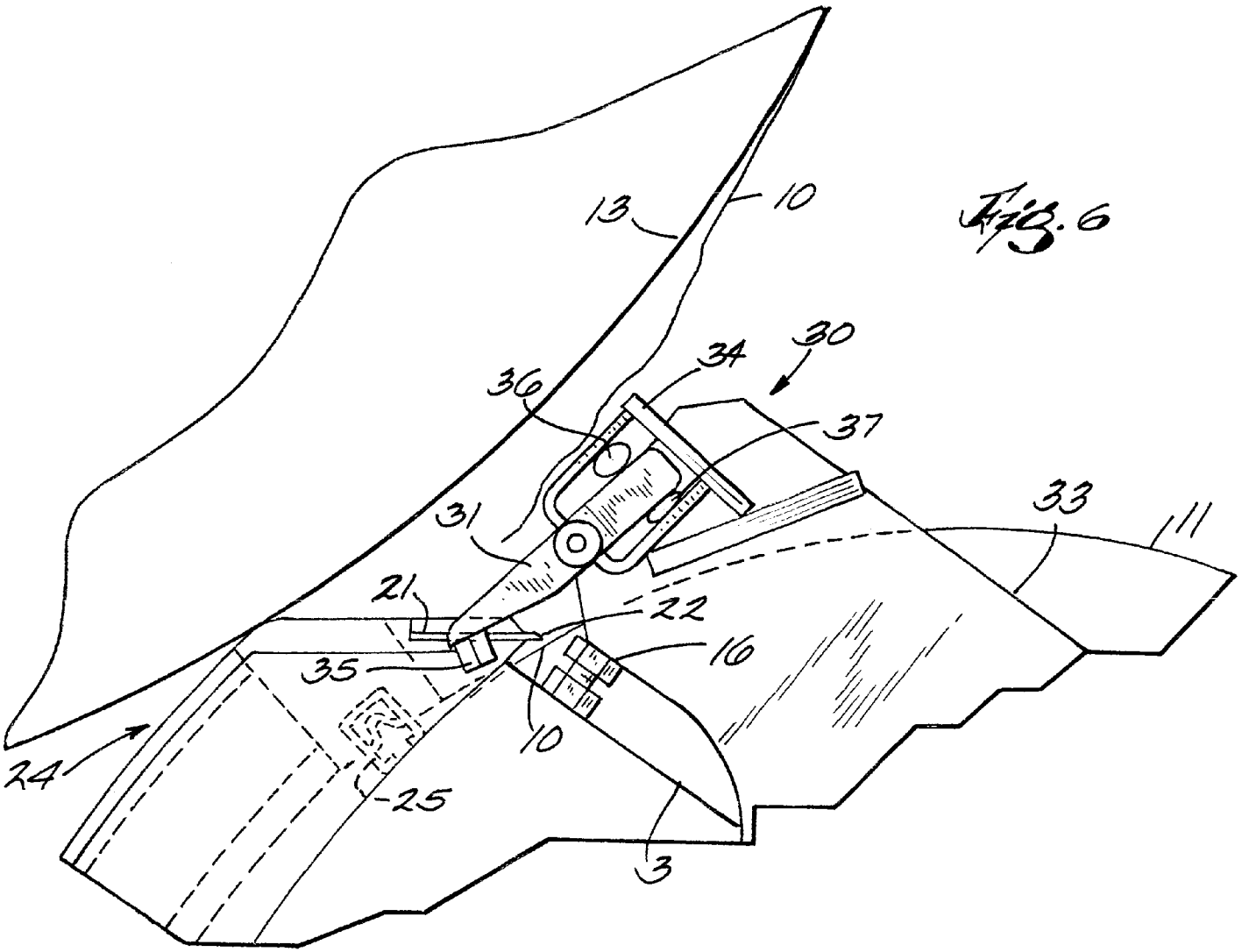
FIG. 6: The same cross cutting device immediately after a crosscut.
Figure 1:
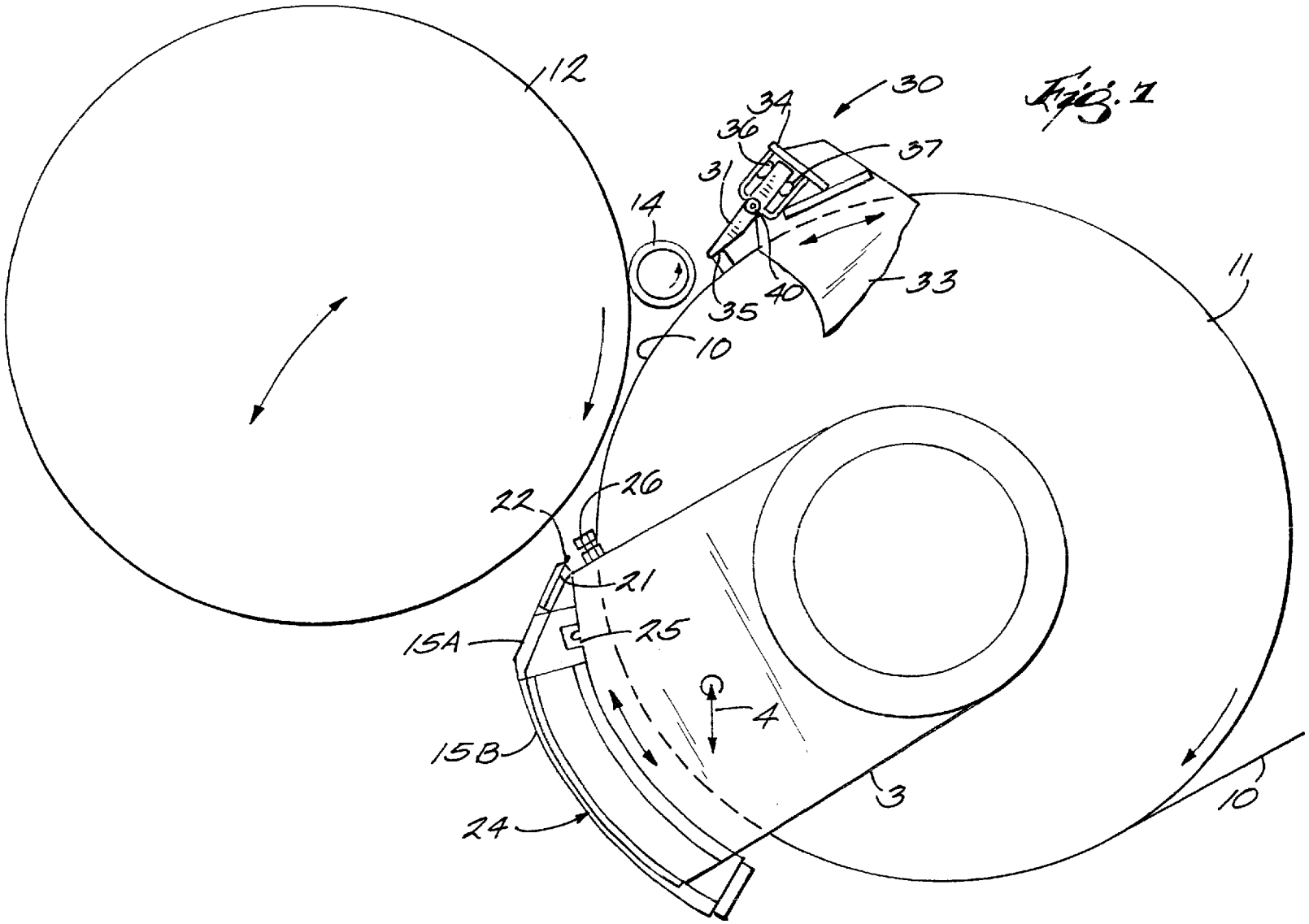

Finger-like clamping means (31), which in the embodiment represented are in the form of double-armed levers, are fastened to the clamping-means carrier 34 in a manner that permits a pivoting motion. As is evident from FIG. 3, the clamping means 31 feature a lateral clearance from each other as well as a length and particularly a width of the clamping blocks 35 in such a manner that the clamping blocks 35 fit into the border recesses 23 of the cross cutting blades 21 with sufficient play. All the clamping means 31 are supported coaxially and can be swung jointly from a home position (right representation in FIG. 5) to a clamping position (left representation in FIG. 5) and back by means of tubular pressurized cushions 36, 37. This swinging is not carried out until the swinging arms 33 have come to rest on the limit stop 26. The clamping blocks 35 then overlap the web edge formed as a result of the crosscut. This is represented in a simplified and greatly enlarged form in FIG. 6. Now the cross cutting blade can travel back to its home position represented as a dotted-dashed line in FIG. 1, the carrier roll 12 can travel close to the carrier roll 11, and a winding core or cores 14 for the next winding process can be loaded in direct proximity of the clamping blocks 35 (FIG. 7).

In the second embodiment according to FIGS. 8 to 13, a perforation and adhesive-dispenser device 40 is used being mounted on a carriage 41 which can travel along a guidance 42 in cross machine direction in a position below the first carrier roll 11 along its total length. First and second carrier rolls 11, 12 being covered with one or several soft cover layers 11A. 12A as known per se in the art.

Figure 8:
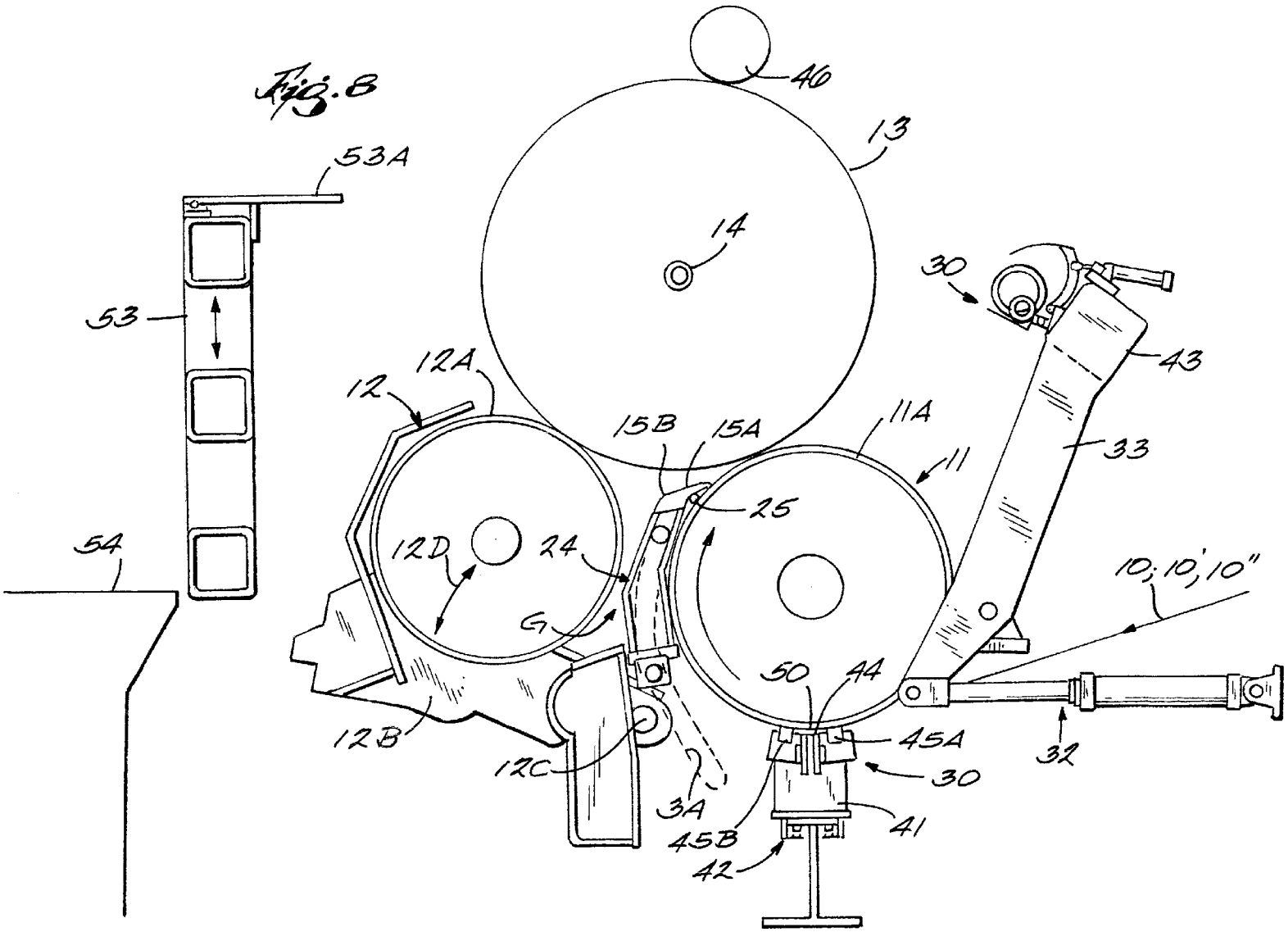
FIG. 8: A winding machine in a second embodiment having a cross cutting device in side view with a nearly completed wound roll of winding material.

In the particular phase of the winding process shown in FIG. 8, a driven beam 43 supporting the clamping device 30 is in its up-position. Carriage 41 traverses web 10 or webs 10', 10", . . . being wrapped around first carrier roll 11 and applies adhesive, perforates the web and applies UV light to cure the adhesive. A perforation and adhesive-dispenser device 40 of this type is known per se in the art (U.S. Pat. No. 5,092,533=EP-B1-0 553 232, which are incorporated herewith by reference). However, the perforation device of the second embodiment differs from known perforation devices in that a rotating perforation means 44 with dents or the like at its periphery is used and applied in such a way that the perforation means perforates the web in a position which is very close to the outer surface of soft covered first carrier roll 11 and—as shown in FIG. 13—preferably in a position where the carrier roll 11 is wrapped by the web 10. Thereby, no extra support from the opposite side of the web is used for entering the perforation means into the web. In the case where the first carrier roll 11 is soft covered, neither its surface nor the perforation means is damaged because the parts of the perforation means cutting through the web will only touch the soft cover 11A which will give sufficient way to the perforation means to enter the periphery of the first carrier roll 11 as required for optimal perforation. This type of perforation and perforation device has inventive meaning by its own, i.e., even without the other parts of the cross cutting device of the subject invention. The same applies to the way of supporting the perforation means on the carriage 41.

In the case where the first carrier roll is hard (not particularly shown in the drawings), such as an uncovered steel drum, the method of perforating the sheet is similar but at the cost of several advantages. The advantage of a soft covered drum is that the rotatable perforation blade stays sharp longer. Another advantage of the soft covers is that the per cent perforation, when used with a so called ventacrooved drum, can be varied by varying the cutting force.

Figure 13A:
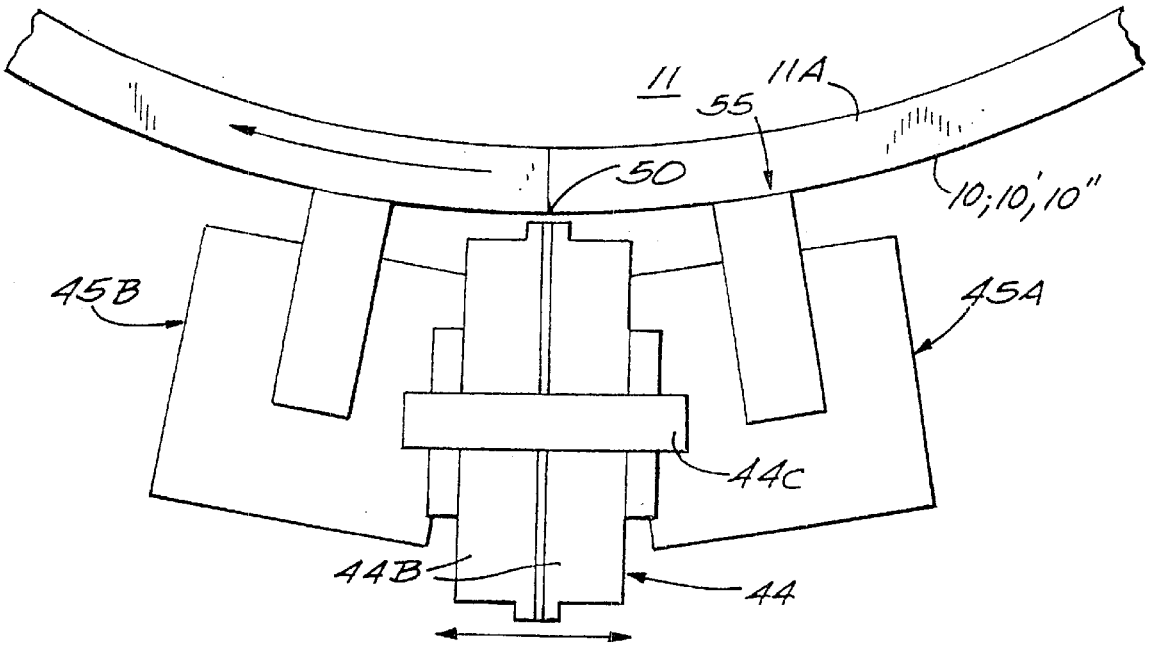
FIG. 13D: The embodiment of FIG. 13A with an enlargement of the rotating perforation device shown in FIG. 13A.
Figure 13B:
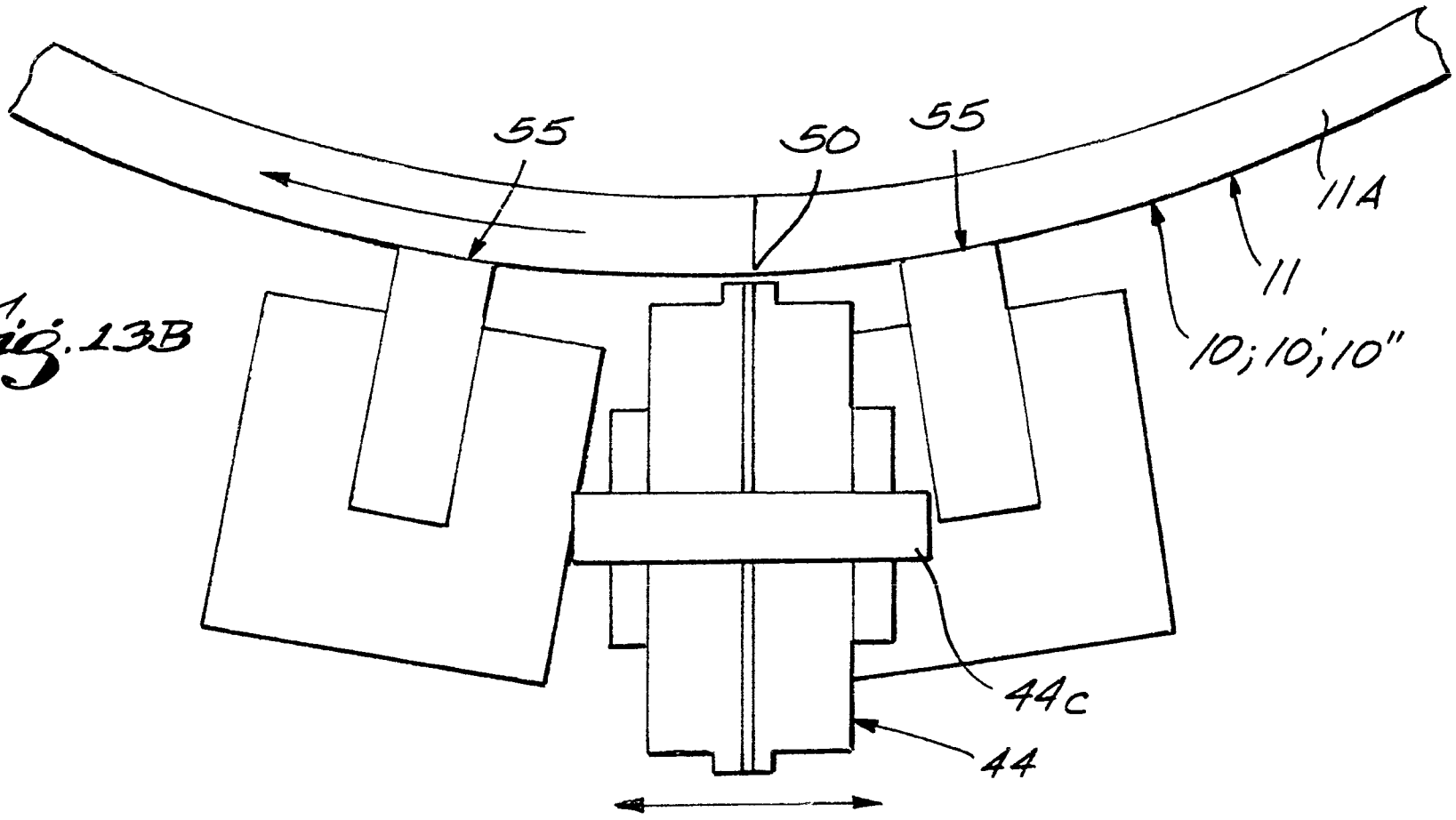
Figure 13C:
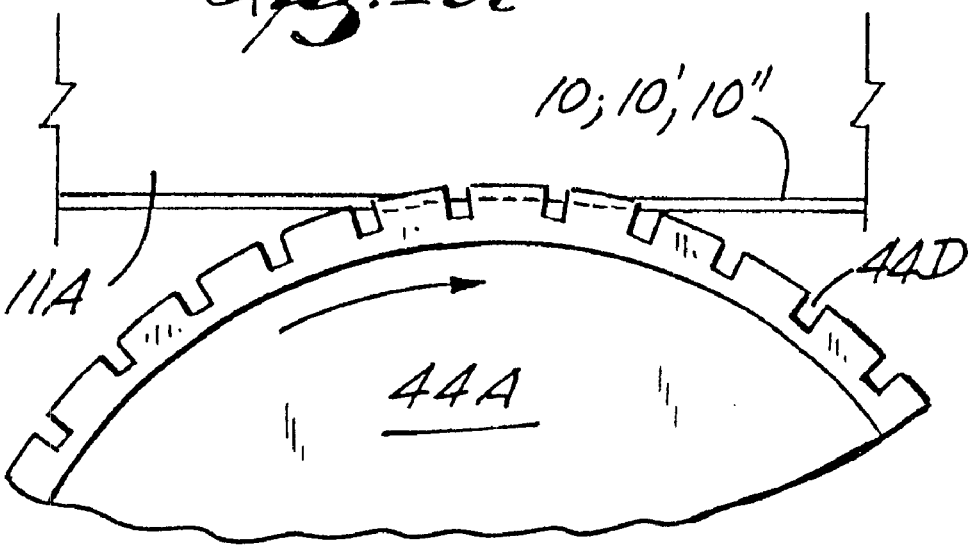
Figure 13D:
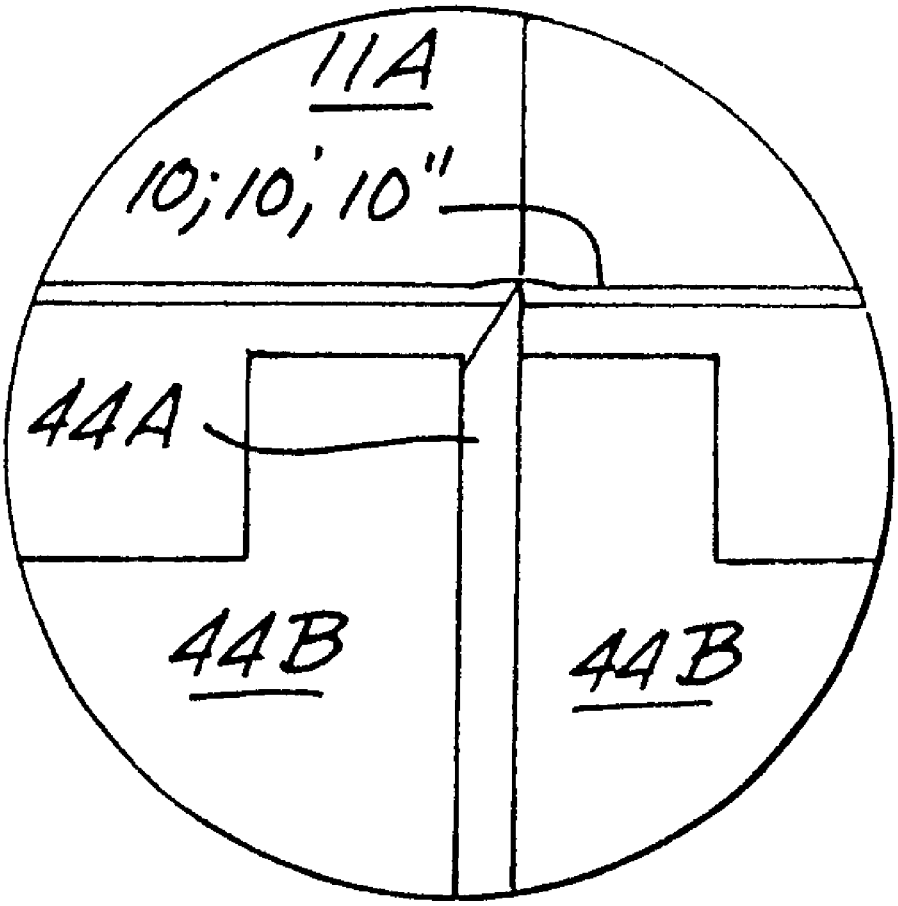

As appreciated and shown with the second embodiment, especially in FIGS. 13A to 13C, adhesive will be applied to the web on both sides of the perforation means along but laterally spaced from the perforation line 50. The adhesive-dispensers 45A, 45B maintain a constant distance from each other while the perforation means 44 can be moved laterally as to be positioned closer to one or the other of the adhesive dispensers 45A, 45B—or being positioned in the middle between both. Of course, it is also possible to keep the perforation means 44 stationary with respect to the running direction of web 10 and to move adhesive-dispensers 45A, 45B for varying the distances with respect to the perforation means 44. This possibility of adjustment of relative position of the perforation means 44 with respect to the adhesive-dispensers 45A, 45B allows to optimize the sticking of the arriving web to a new winding core. Insofar, the adjustment of the distance between perforation means 44 and adhesive-dispenser 45A is of particular importance. It was found out that web materials with different properties, like relatively stiff papers or relatively flexible papers as well as the choice of winding core diameter are leading factors for the optimal distance between perforation line 50 and the line where adhesive is applied to the arriving web for sticking the same to the next winding core.

Figure 9:
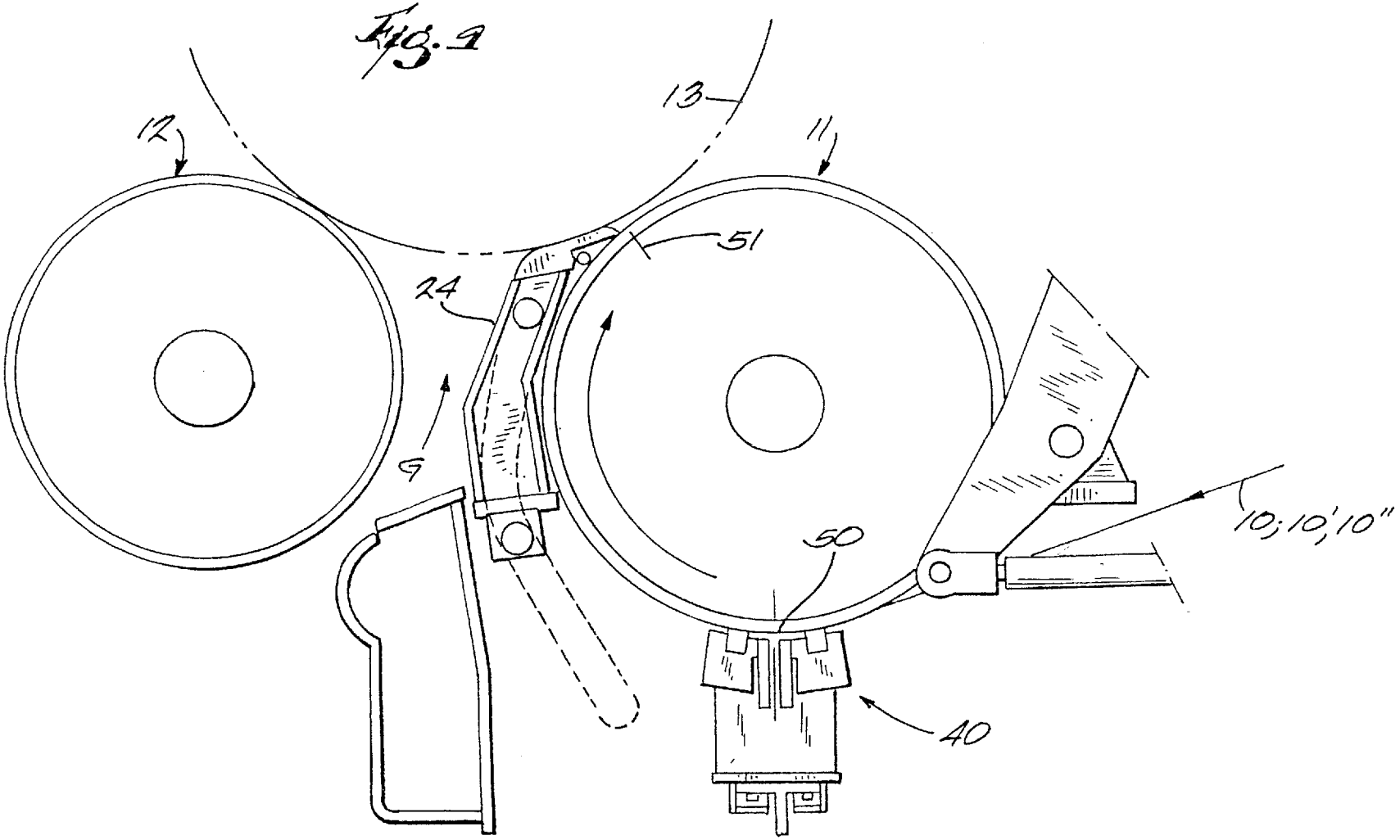
FIG. 9: The same (second) cross cutting device in an enlarged view of the winding bed with the cross cutting device in its working position.
Figure 9A:
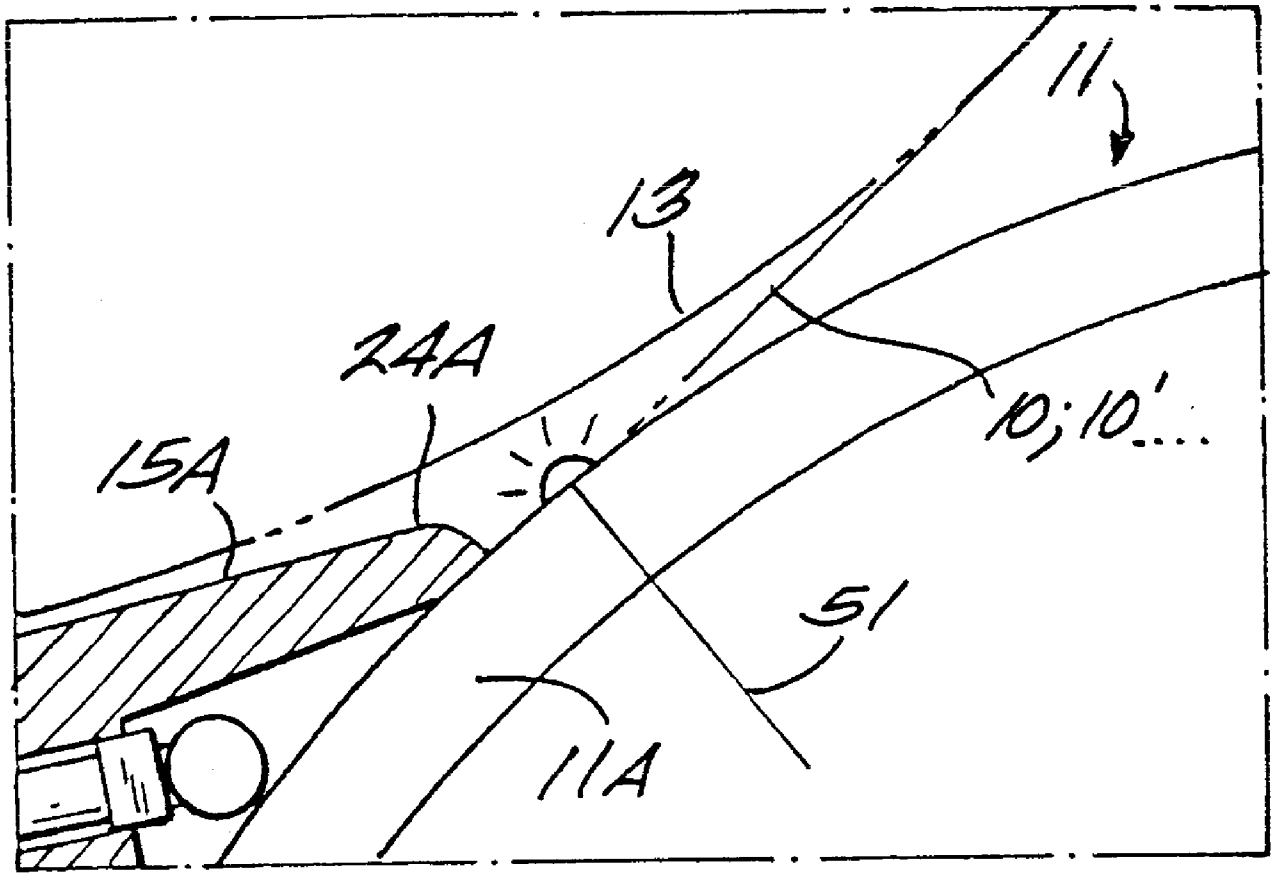
FIG. 9A: The embodiment of FIG. 9 with an enlargement of the crosscutting zone shown in FIG. 9.

As can be seen in FIG. 9, after finishing a roll 13 and perforating the web 10; 10', 10", . . . by the perforation and adhesive-dispenser device 40, the first carrier roll 11 transports the perforation line 50 from the 6 o'clock-position to the final cross cutting position, indicated by a marker 51 in the drawing. After the perforation line has arrived in the cross cutting position 51, the first carrier roll 11 is stopped and the second carrier roll 12 is started to be lowered considerably by lever means 12B around pivot 12C according to arrow 12D as can best be seen from FIG. 8. By this lowering the wound roll 13 leaves the surface of first carrier roll 11 and moves onto the run-off diagonal 15A of support beam 24, an extension 24A of which is thereby pressed against the surface of first carrier roll 11 to clamp web 10 or webs 10', 10", . . . along the whole width in cross machine direction. The lowering of second carrier roll 12 and keeping the rotation of first carrier roll 11 stopped, leads to a tensioning of web 10 between extension 24A of support beam 24 and wound roll 13, as can best be seen from the enlarged detail of FIG. 9. This tension is high enough to tear the web/webs along perforation line 50.

Figure 10:
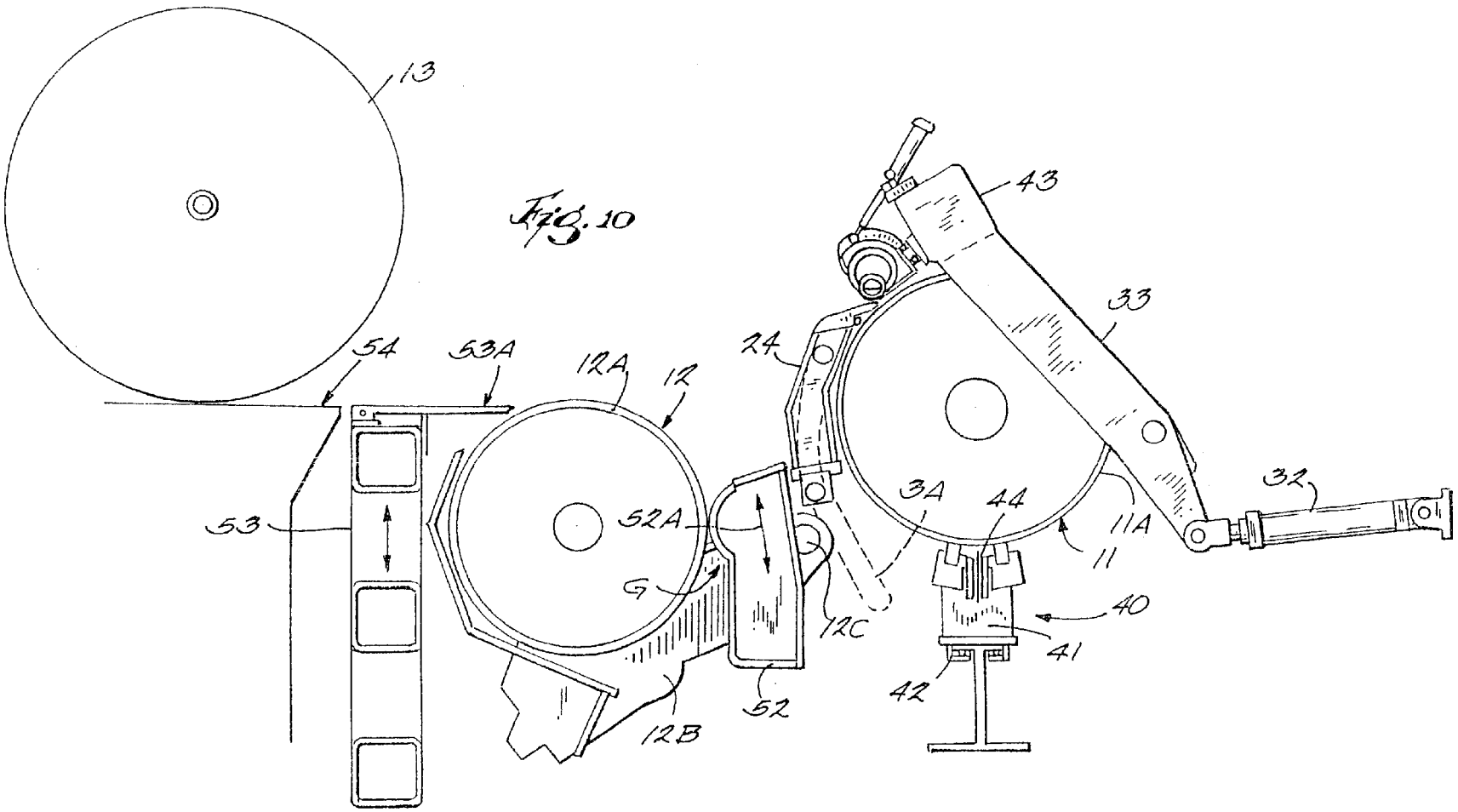
FIG. 10: From the same (second) embodiment, a further working position of the cross cutting device in which a clamping device has arrived over the cross cutting zone with new winding cores after the leaving web and has left the cross cutting zone together with the wound roll.

Next to the cross cutting event, shown in FIG. 9, the wound roll 13 is moved into its unloaded position, as shown in FIG. 10, by further lowering second carrier roll 12 and pushing roll 13 by pusher 52, which is movable along arrow 52A, over the apex of second carrier roll 12 and top plate 53A of movable security grid 53 to floor 54. As the weight of roll 13 has left extension 24A of support beam 24 by that time, extension 24A and/or support beam 24 will flex back to an unloaded position as shown in the enlarged detail drawing of FIG. 10. In order to avoid the need of a vacuum being supplied to the surface of first carrier roll 11 in order to keep the arriving edge of web 10 in the cross cutting position 51, support cushion 25 is pressed by drive means 25A being arranged in support beam 24 against the periphery of first carrier roll 11 close to the cross cutting position 51 and thereby also close to the extension 24A. The support cushion 25 acts as a clamping means and can be made from small diameter rolls of medium sized length being rotatably mounted between drive means 25A which are spaced to each other in cross machine direction according to the length of the cushions 25. Thereby, each drive means 25A normally supports two neighbored cushions 25.

As can further be seen from FIG. 10, a new set of winding cores 14, which may be of different diameters used for several webs 10', 10", . . . , are fed by beam 43 being swung into its clamping position by driving means 32. The details of clamping device 30 which includes the core feeding device in integrated manner, will be explained with respect to FIGS. 11 and 12. However, as can be seen from the enlarged detail drawing in FIG. 10, the clamping device 30 brings a clamping blade 31A and cores 14 into right position for clamping the arriving web edge extremely close to the perforation and cross cutting line 50.

Figure 11:
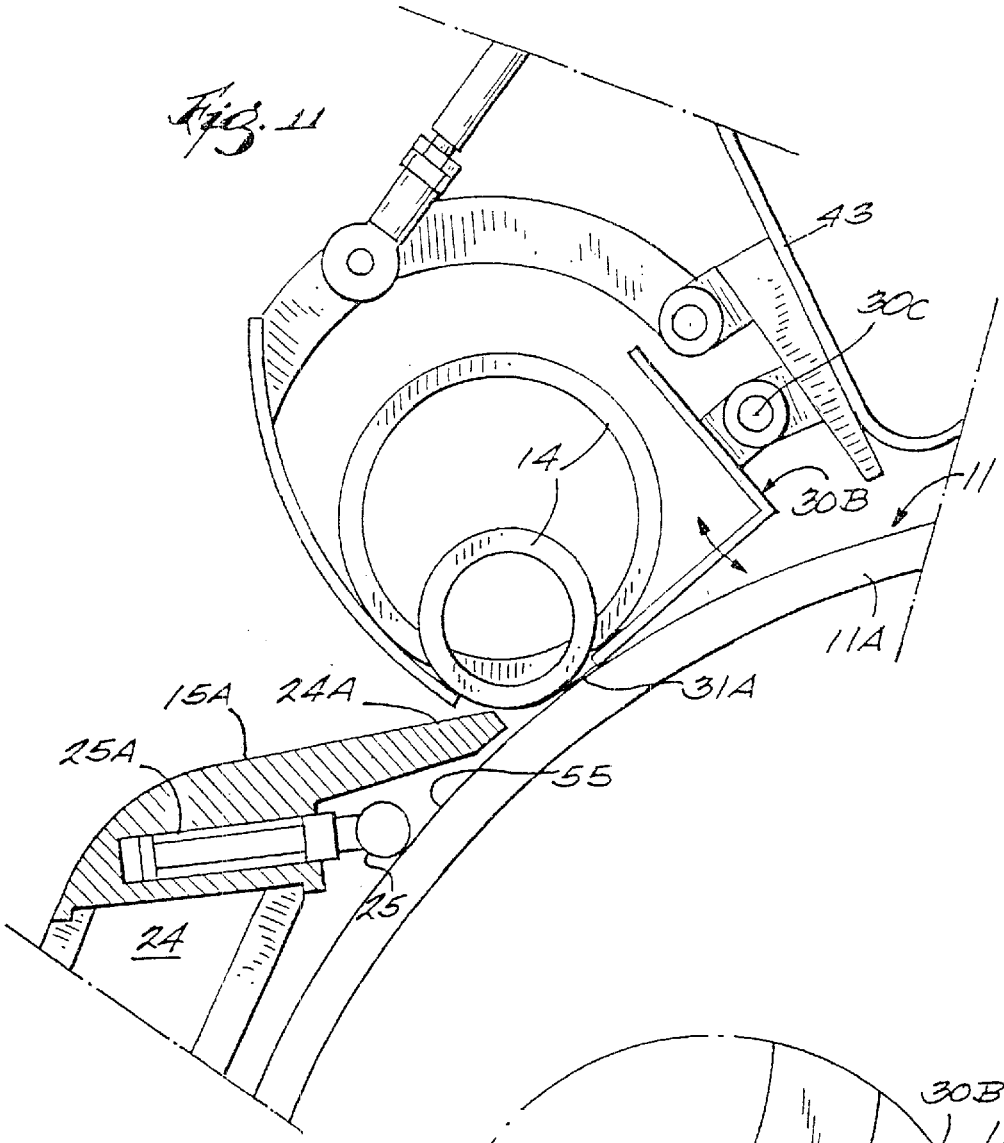
FIG. 11: The same (second) embodiment with a clamping device in its clamping position.
Figure 11A:
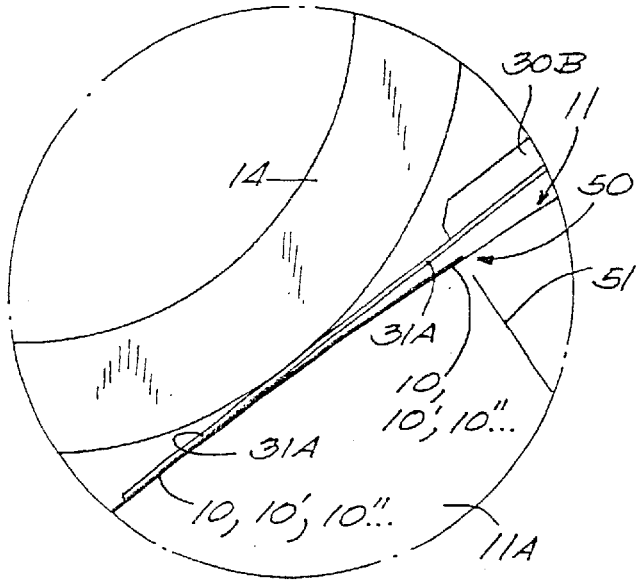
FIG. 11A The embodiment of FIG. 11 with an enlargement of the crosscutting zone shown in FIG. 11.
Figure 12:
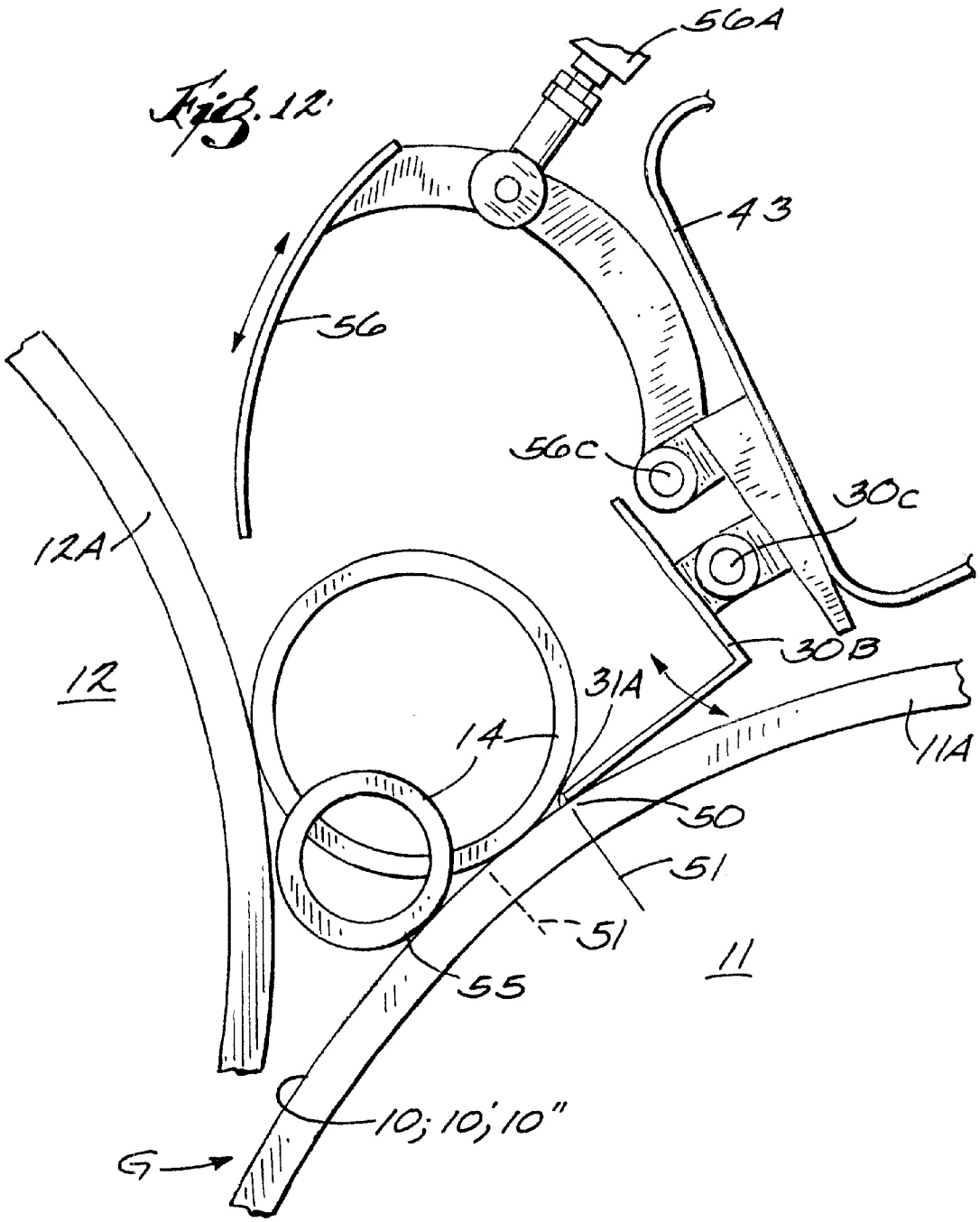
FIG. 12: The same (second) embodiment in a working position where the cross cutting means has left the cross cutting zone, the second carrier roll has formed a new winding bed with the first carrier roll and the clamping device is feeding a new set of winding cores for the subsequent winding process and FIGS. 13A–C The same (second) showing in more detail the perforation device.

As will be appreciated from FIGS. 11 and 12, the clamping device 30 comprises an angled trough 30B which acts at the same time as a receiving trough for a set of winding cores 14. Trough 30B comprises an extension, like an elongated blade of spring steel which acts as a clamping blade 31A in order to smoothly being pressable against the arriving edge zone of web 10/webs 10', 10", . . . which is shown in enlarged detailed drawing of FIG. 11. The shed 30B can slightly be swung from its core keeping position, shown in FIG. 10, into the core unloading- and clamping position, shown in FIG. 11, around pivot 30C by any appropriate drive means.

As can best be seen from FIG. 12, beam 43 also supports a retainer means 56 which secures the cores 14 when they are disposed in the shed 30B in the core feeding position, as shown in FIGS. 10 and 11. For releasing the cores 14 from the shed 30B into the winding bed, as shown in FIG. 12, the retainer means 56 is pivoted around pivot 56C by drive means 56A. As can further be seen from FIG. 12, the adhesive 55, applied to web 10 by adhesive-dispenser 45A is spaced from the perforation line 50 as much as necessary to stick the new winding core 14 with the smallest diameter safely to the arriving web edge. As shown in dotted lines, the cross cutting position may be positioned closer to the adhesive 55, when only small diameter cores are used—for instance by using a laterally movable rotating perforation means 44 as explained hereafter with respect to FIG. 13A to 13C.

As shown in FIGS. 13A and 13B, the rotating perforation means 44 which is rotatably supported around rotation axis 44C can be moved by any suitable drive between its center position, shown in FIG. 13A, and any off-center positions as for example shown in FIG. 13B between adhesive-dispensers 45A and 45B.

As can best be seen from FIG. 13C and the enlarged detail of FIG. 13A, the rotating perforation means comprises a ring-like or disk-like cutting blade 44A which is clamped by support means 44B and rotatable around axis 44C and comprises border recesses 44D allowing short bridges of material to remain in the web after carriage 41 has been run along guidance 42 and cutting blade 44 has perforated web 10 by rotating along the web in cross machine direction entering only a small amount into the soft cover 11A of first carrier roll 11, which can best be seen from the enlarged detail of FIG. 13A.

| List of reference numbers | |
|---|---|
| 3 | Swinging arm |
| 3A | Guidance |
| 4 | Pivot drive |
| 10, 10', 10" | Winding material |
| 11 | Carrier roll |
| 11A | Soft cover |
| 12 | Carrier roll |
| 12A | Soft cover |
| 12B | Lever means |
| 12C | Pivot |
| 12D | Arrow |
| 13 | Roll |
| 14 | Winding cores |
| 15A | Run-off diagonal |
| 15B | Run-off diagonal |
| 21 | Cross cutting blade |
| 22 | Cutting edge |
| 23 | Border recesses |
| 24 | Support beam |
| 24A | Extension |
| 25 | Support cushion |
| 25A | Drive means |
| 26 | Limit stop |
| 30 | Clamping device |
| 30B | Trough |
| 30C | Pivot |
| 31 | Clamping fingers |
| 31A | Clamping blade |
| 32 | Driving means |
| 33 | Swinging arm |
| 34 | Clamping-means carrier |
| 35 | Clamping blocks |
| 36 | Pressurized cushion |
| 37 | Pressurized cushion |
| 40 | Perforation- and adhesive-dispenser device |
| 41 | Carriage |
| 42 | Guidance |
| 43 | Beam |
| 44 | Rotating perforation means |
| 44A | Cutting blade |
| 44B | Support means |
| 44C | Rotation axis |
| 44D | Border recesses |
| 45A/B | Adhesive-dispensers |
| 46 | Rider roll |
| 50 | Perforation line |
| 51 | Cross cutting position |
| 52 | Pusher |
| 52A | Arrow |
| 53 | Security grid |
| 53A | Top plate |
| 54 | Floor |
| 55 | Adhesive |
| 56 | Retainer means |
| 56A | Drive means |
| 56C | Pivot |
| A | View |
| G | Clearance gap |

New claims:

1. Cross cutting device for a winding machine, having at least a first carrier roll (11) in order to wind winding material (10), particularly of paper, in the form of a web, having a cross cutting means to cut or sever a web (10) after completion of a roll (13), and having a first and a second clamping device in order to securely clamp a web edge formed by means of the cross cutting before and after the cross-cutting action respectively, characterized in that the cross cutting means being conductible in a way known per se by a support beam (24) through a clearance gap (G) betweeen said first and second carrier roll or close to the periphery of said first carrier roll (11) into a cross cutting position (51) of the cross cutting means, said cross cutting position being close to the surface of said first carrier roll (11) around which said web is wrapped, and comprising means to press said support beam (24) by a weight of a finished roll (13), against said wrapped first carrier roll (11), and that the cross cutting means being conductible back through the clearance gap (G) of said carrier rolls (11, 12) to a home position.

2. Cross cutting device according to claim 1 characterized in that said second clamping device (30) being conductible counter to the web running direction into a clamping position and there, overlapping the arriving web edge of the next roll to be wound, securely clamps said arriving web edge independently of the cross cutting means, and said second clamping device (30) after a new winding core or cores (14) has/have been loaded, being detachable from the web edge and being conductible back to a home position of said second clamping device in the web running direction.

3. The cross cutting device of claim 2, characterized in that the second clamping device comprises clamping fingers (31) in the form of levers featuring a joint pivot drive (34, 36, 37).

4. The cross cutting device of claim 2, characterized by a limit stop (26), effective between the support beam (24) and said second clamping device (30), in order to establish a clamping position which corresponds to a relevant cross cutting position.

5. The cross cutting device of claim 2, characterized in that said second clamping device (30) is acting as a feeder for new winding cores to be fed into the winding bed formed by said carrier rolls while the arriving web edge is clamped to the wrapped first carrier roll by the second clamping device.

6. The cross cutting device of claim 2, characterized in that said second clamping device (30) comprises a trough (30B) being pivotable from a feeding position to a clamping position around a pivot (30C).

7. The cross cutting device of claim 2, characterized by a flexible material strip extending in cross machine direction and being pressable from radially outside onto a corresponding strip of web material extending next to the cross cutting position at an arriving edge zone of the web.

8. The cross cutting device of claim 2, comprising a feeder for new winding cores (14), integrated with said second clamping device (30) and having a retainer means (56), said retainer means being pivotable to release the new winding cores when the second clamping device (30) has reached said clamping position.

9. The cross cutting device according to claim 1, characterized in that a perforation means for perforating (44) is positioned off-set of said cross cutting position (51) and the cross cutting means for cross cutting or severing the web (10) in the cross cutting position (51) comprises a clamping means being arranged close to a front edge of said support beam (24) and being arranged to clamp the arriving web edge close to or at the perforation line (50) after the perforation line (50) has arrived in the cross cutting position (51).

10. The cross cutting device according to claim 9, characterized in that said clamping means being positioned to leave a strip of web material uncovered, said strip extending between said perforation line (50) and the front edge of the support beam (24) or an extension 24A of the support beam respectively.

11. The cross cutting device according to claim 9, comprising said perforation means (44) and at least one adhesive-dispenser (45A, 45B) being spaced from the perforation means in the web running direction, the distance between both being adjustable in accordance with the diameter of the winding cores.

12. The cross cutting device of claim 1, characterized by a rotatable perforation means for perforating (44) being arranged in a position in which the web to be perforated touches the surface of the wrapped first carrier roll (11).

13. The cross cutting device according to claim 12, characterized in that said carrier roll being covered by a soft cover (11A) allowing the penetration of the periphery zone of the perforation means into the periphery zone of the carrier roll (11).

14. The cross cutting device of claim 1, characterized by support cushions (25) for supporting the support beam (24) on said wrapped first carrier roll (11) close to the cross cutting position.

15. The cross cutting device of claim 14, characterized by drive means for moving said support cushions (25) from a home position to a working position in which working position the support cushions abut onto the wrapped first carrier roll (11).

16. The cross cutting device according to claim 1, characterized in that the cross cutting means comprises a cross cutting blade (21) with a cutting edge (22).

17. The cross cutting device according to claim 16, characterized in that the cross cutting blade features border recesses which stand back behind said cutting edge, and the first clamping device features clamping means which fit into the border recesses.

18. A method for cross cutting or severing a web of a winding material in a winding machine having at least a first carrier roll wrapped partly by said web and supporting the roll of wound winding material comprising the steps:

a) conducting a support beam for a cross cutting or severing means from a home position into a cross cutting or severing position being close to the surface of said first carrier roll around which the web is wrapped, b) moving the finished wound roll of winding material from a winding position onto said support beam, thereby pressing an elongated straight bar or blade being arranged in parallel to said first carrier roll and being supported by said support beam against said web and said first carrier roll for holding said web flat and tight on said carrier roll, c) moving the finished roll further in the moving direction of step b), thereby tensioning said web between said finished wound roll and said straight bar or blade until said web tears off close to said bar or blade, d) conducting said support beam back to said home position.

* * * * *